United States Patent [19]

Arteau et al.

[11] Patent Number: 4,787,475

[45] Date of Patent: Nov. 29, 1988

[54] SAFETY FENCE ASSEMBLY FOR USE IN A BUILDING UNDER CONSTRUCTION

[75] Inventors: Jean Arteau; Raymond Bertrand, both of Montreal, Canada

[73] Assignee: Instit de Recherche en Sante et en Securite du Travail du Quebec, Quebec, Canada

[21] Appl. No.: 140,028

[22] Filed: Dec. 31, 1987

[51] Int. Cl.[4] ..... E04G 21/32; E04G 1/26

[52] U.S. Cl. ..... 182/82; 182/113; 256/DIG. 6; 256/65

[58] Field of Search ..... 182/113, 82; 256/DIG. 6, 59, 65

[56] References Cited

U.S. PATENT DOCUMENTS

| | | | |
|---|---|---|---|
| 3,406,946 | 10/1968 | Saultz | 256/65 |
| 3,425,509 | 2/1969 | Gilbert | 182/113 |
| 3,752,262 | 8/1973 | Helms | 182/113 |
| 3,863,899 | 2/1975 | Werner | 182/113 |
| 3,881,699 | 5/1975 | Nusbaum | 182/82 |
| 3,901,481 | 8/1975 | Probst | 256/59 |
| 3,920,220 | 11/1975 | Elias | 256/65 |
| 4,174,096 | 11/1979 | Campbell | 256/65 |
| 4,236,698 | 12/1980 | Compte | 256/DIG. 6 |
| 4,565,261 | 1/1986 | Maier | 182/113 |

FOREIGN PATENT DOCUMENTS

| | | | |
|---|---|---|---|
| 814167 | 6/1969 | Canada | 182/113 |
| 2589507 | 5/1987 | France | 182/113 |

*Primary Examiner*—Reinaldo P. Machado

*Attorney, Agent, or Firm*—Foley & Lardner, Schwartz, Jeffery, Schwaab, Mack, Blumenthal & Evans

[57] ABSTRACT

The disclosure herein describes a safety fence assembly for mounting to a floor of a building under construction; it comprises guard rail structures, each formed of at least an upper rail and of a pair of uprights. Hinge elements are mounted to the opposite ends of the upper rail, at least one of the hinge elements being slidably mounted to one end of the rail. Each hinge element comprises a vertically extending pivot member which is adapted to be pivotally mounted to a post and a horizontally extending support member which includes an opening therethrough to receive the pivot member of an adjacently disposed guard rail structure. In one form of the invention, both hinge elements are movable along the upper rail while, in another form, one hinge element is fixed while the other is movable.

24 Claims, 3 Drawing Sheets

SAFETY FENCE ASSEMBLY FOR USE IN A BUILDING UNDER CONSTRUCTION

FIELD OF THE INVENTION

The present invention relates to a safety fence assembly for mounting to a floor of a building under construction.

BACKGROUND OF THE INVENTION

Safety fences or barriers are used in connection with the construction of buildings and are adapted for temporary installation adjacent the outer perimeters of floors to provide for the personal safety of the workers and also to prevent items lying on the floor from being accidentally displaced over the edges.

These fences are usually made up of individual sections, each section including longitudinally extending spaced rails which are secured in their space relationship by uprights positioned at intervals along each section.

These safety fence assemblies are temporary and therefore should possess the attributes of ease of mounting and dismounting. In addition, they should be adjustable in length to guard platform perimeters of various lengths without the need of having to carefully align adjacent guide rail sections or fixed sectional components together.

It is often desirable that some sections be made easily openable to provide access outside the perimeter of the floor whenever required.

OBJECTS AND STATEMENT OF THE INVENTION

It is an object of the invention to provide a safety fence assembly which may be easily and quickly mounted to and dismounted from platform perimeters.

It is also an object of the invention to provide a safety fence assembly in which any section may be easily opened.

The present invention therefore relates to a safety fence assembly for mounting to a floor of a building under construction which comprises:

- post means adapted to be vertically mounted to the floor;
- at least one guard rail structure including at least an upper rail and upright means secured to the upper rail to define therewith a frame;
- first hinge means mounted to the upper rail at one end thereof, these hinge means including a vertically extending pivot member adapted to be pivotally mounted to the upper end of a post means, or to hinge means of an adjacently disposed guard rail structure, and a horizontally extending support member having an opening therethrough to receive a pivot member of an adjacently disposed guard structure; and
- movable second hinge means slidably mounted to the upper rail at an opposite end thereof, the movable hinge means including:
  - a member slidably mounted to the upper rail;
  - a pivot member vertically extending from the sliding member and adapted to be pivotally mounted to hinge means of an adjacently disposed guard rail structure, or to the upper end of the post means; and
  - a support member horizontally extending from the sliding member and having an opening for receiving therethrough a pivot member of a hinge means of an adjacently disposed guard rail frame structure.

In one form of the invention, both hinge means are movable along the upper rail while, in a second form, one hinge means is fixed to the upper rail while the other is movable thereon.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
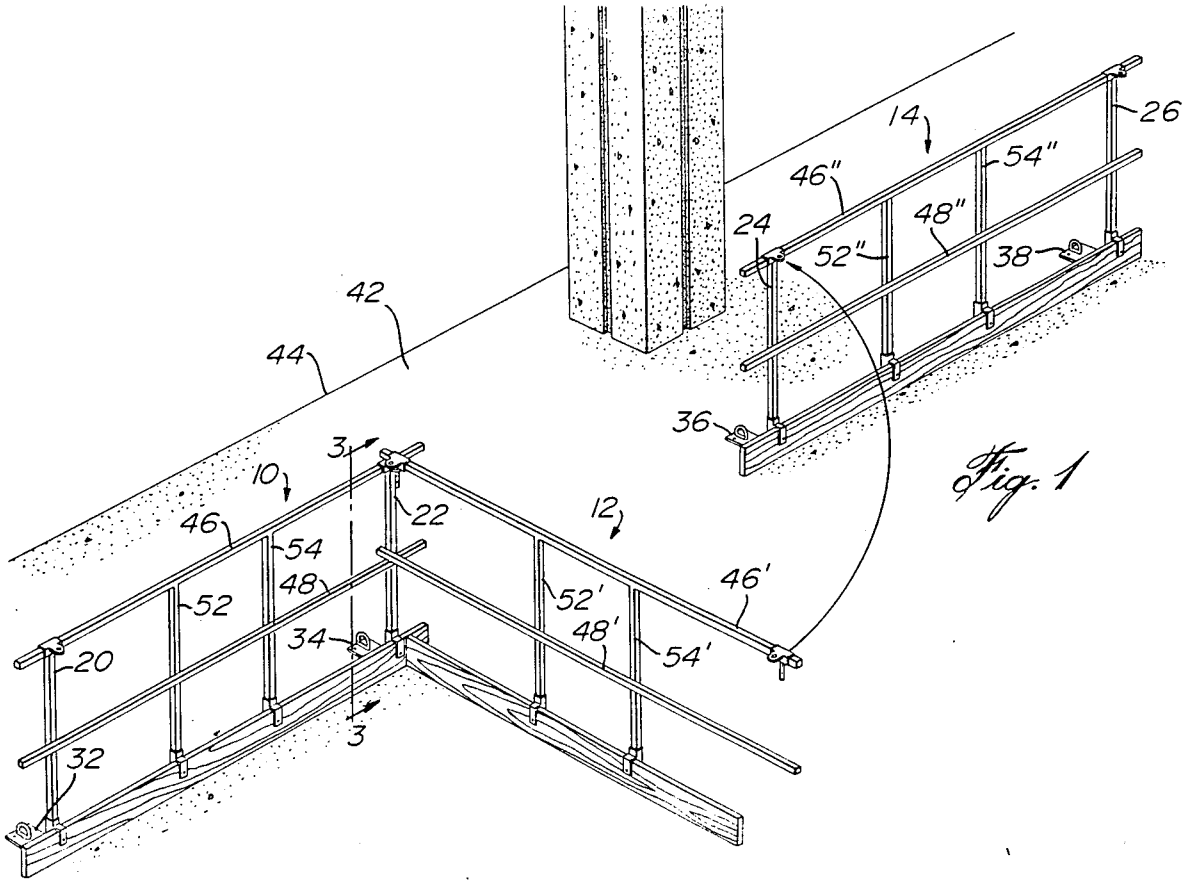
FIG. 1 is a perspective view showing a safety fence assembly made in accordance with the present invention mounted on a floor of a building under construction.

Referring to FIG. 1, there is shown a series of components which make up the assembly of a safety fence which is temporarily installed adjacent the outer perimeter of a wooden or concrete floor of a building under construction for the personal safety of workers.

Figure 2:
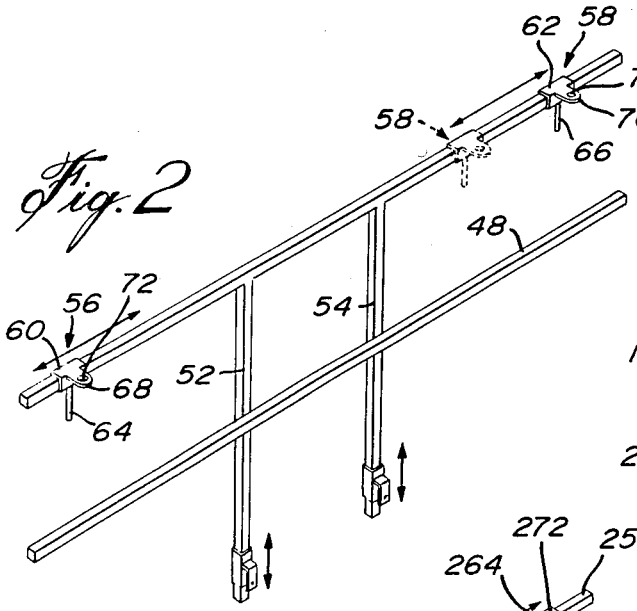
FIG. 2 is an enlarged perspective view showing one section of the fence assembly shown in FIG. 1.

The fence illustrated is made up of a series of sections, three being shown as 10, 12 and 14. Two of these sections (10 and 14) are supported on a series of vertical posts 20 and 22, 24 and 26 each having their lower end loosely engaged to a series of anchor devices 32 and 34, 36 and 38 which are appropriately situated on the building floor 42 adjacent the perimeter 44 thereof. Section 12 of the fence is pivotally mounted, as described hereinafter, to sections 10 and 14 to define an openable section to provide access outside the perimeter of the floor. Sections 10, 12 and 14 are identical in shape and construction and a description of such a section will now be given in relation to FIG. 2. Section 10 comprises an upper rail 46, an intermediate lower rail 48 and a pair of uprights 52 and 54. The upper and lower rails and the uprights are tubular in shape and define a rectangular rail structure. The upper ends of uprights 52 and 54 are integral with (or fixedly secured to) the under side of the upper rail 46 while their lower ends are free. The rail 48 is fixedly secured to a side wall of the tubular uprights 52 and 54 so that the upper rail 46 and the uprights 52 and 54 extend in a same vertical plane, which is slightly offset relative to a vertical plane passing through rail 48.

In this embodiment, the fence section has a pair of hinge connections 56 and 58 which are slidably mounted at the opposite ends of the upper rail 46.

Each hinge 56, 58 includes a tubular collar 60, 62, a vertically extending member 64, 66 in the form of a cylindrical rod, and a horizontally extending support member 68, 70 which projects laterally from rail 46.

Each support member 68, 70 has a circular opening 72, 74, the diameter of which is slightly greater than the outer diameter of the cylindrical rods 64, 66.

Rods 64 and 66 extend in the same vertical plane that includes the upper rail 46 and the uprights, 52 and 54 while the central axis of holes 72 and 74 is in the same vertical plane that includes the rail 48 and which is offset relative to the first mentioned vertical plane.

The outer diameter of rods 64 and 66 is also smaller than the rectangular open ends of the posts 20, 22, 24, 26 so that these rods may be freely pivot within the posts.

Figure 3:
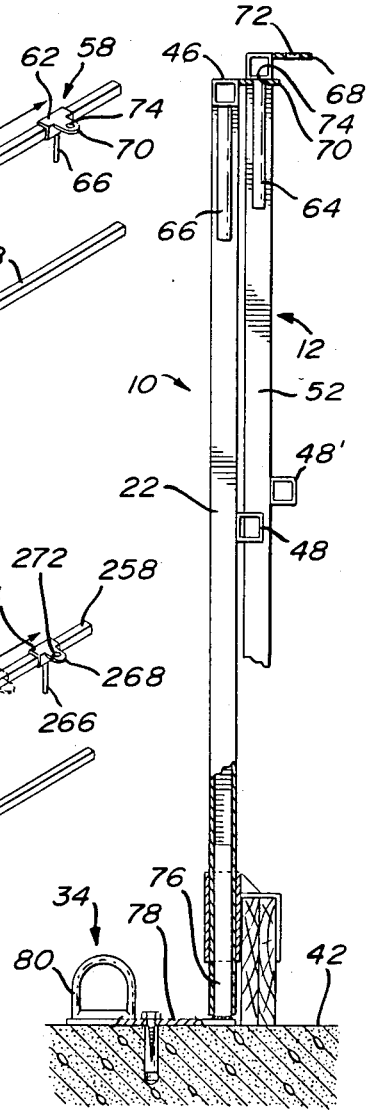
FIG. 3 is a cross-sectional view taken along lines 3—3 of FIG. 1.

Referring to FIG. 3, each post has its lower extremity loosely fitted over a short upstanding support member 76 fixedly secured to a base plate 78 of the anchor device 34. The latter is bolted, in the case of a concrete floor, or nailed, in the case of a wooden floor. Each anchor device also includes a line fastener 80 allowing a construction worker to hook his safety cable at the various work locations on the floor. A more detailed description of such anchor device is given in a patent application filed concurrently herewith by applicant.

To assemble a fence assembly made in accordance with the present invention, sections 10 and 14 are mounted to their respective posts 20, 22, 24, 26, by inserting rods 64 and 66 of each section in the upper open end of the posts. Then, section 12 is mounted to fence section 10 by inserting rod 64 in the opening 74 of hinge 58 of section 10.

The movable hinge 58 of section 12 is longitudinally displaceable on rail 46 so that, whenever section 12 is to remain a fixed section, its rod 66 may be positioned over and slid into opening 72 of the hinge support member 68 of section 14. Once mounted, section 12 is situated in a vertical plane which is slightly offset relative to a vertical plane that includes the upper rail 46, 46" and uprights 52, 54, 52", 54" of sections 10 and 14.

Figure 4:
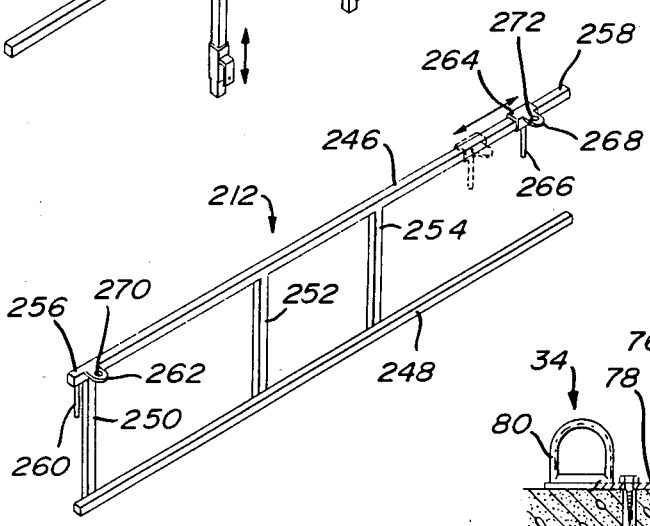
FIG. 4 is an enlarged perspective view showing another embodiment of a fence section made in accordance with the present invention.

Referring to FIG. 4, another embodiment of a fence section is illustrated. Section 212 comprises an upper rail 246, a lower rail 248 and a series of uprights 250, 252 and 254. The upper and lower rails and the uprights are tubular displaying a rectangular cross-section. The upper ends of uprights 250, 252 and 254 are integral with or fixedly secured to the underface of the upper rail 246 while their lower ends are fixedly secured to a side wall of the tubular lower rail 248 so that the upper rail 246 and the uprights 250, 252 and 254 extend in a same vertical plane, which plane is slightly offset to a vertical plane that would include the longitudinal axis of the lower rail 248.

This fence section 212 has a fixed hinge connection at one end 256 of the upper rail and a movable hinge connection slidably mounted at the opposite end 258 thereof.

The fixed hinge connection includes a vertically extending pivot member 260, in the form of a cylindrical rod, and a horizontally extending support member 262 which projects from a side wall of the tubular upper rail 246.

The movable hinge connection includes a tubular collar 264 to which are fixedly secured a vertically extending pivot member 266, in the form of a cylindrical rod, and a horizontally extending support member 268.

Each lug 262, 268 has a circular opening 270, 272, the diameter of which is slightly greater than the outer diameter of the cylindrical rods 260, 266.

The rods 260 and 266 extend in the same vertical plane that includes the upper rail 246 and the uprights 250, 252 and 254 while the central axis of holes 270 and 272 is in the same vertical plane that includes the lower rail 248 and which is offset to the vertical plane just described.

The outer diameter of the rods 260 and 266 is also smaller than the rectangular openings at the upper extremity of the posts 20, 22, 24, 26 (shown in FIG. 1) so that these rods may be freely received and pivot within the posts.

Figures 5, 6:
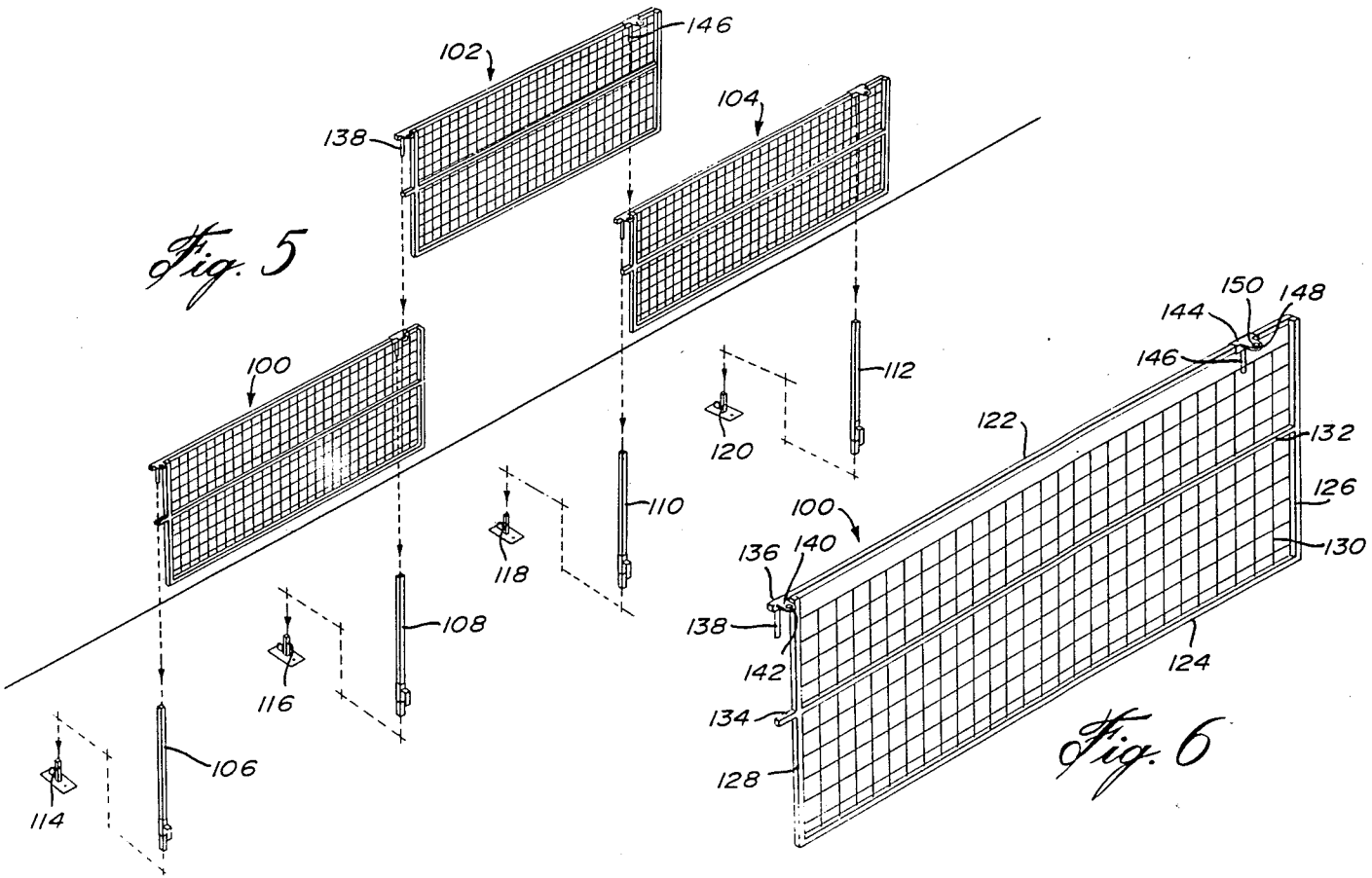
FIG. 5 is an exploded perspective view showing another embodiment of a safety fence assembly made in accordance with the present invention.
FIG. 6 is an enlarged perspective view showing one section of the guard rail structure shown in FIG. 5.

Referring to FIGS. 5 and 6, there is shown another embodiment of a fence assembly made in accordance with the present invention. In this embodiment, three sections of identical constructions are shown as 100, 102 and 104 with four posts 106, 108, 110 and 112, the lower ends of which are loosely mounted in anchor devices 114, 116, 118 and 120, the construction of which somewhat differs from that shown in FIG. 1 (i.e. different location of the short support member).

Referring more particularly to FIG. 6, the construction of one section of the fence assembly is shown. Section 100 is defined by a rectangular frame that includes an upper rail 122, a lower rail 124 and uprights 126 and 128. A screen 130 extends between the two uprights 126 and 128 and the lower rail 124. An intermediate stabilizing bar 132 extends transversely of the frame with one end 134 protruding outside the upright 128. The lower rail 124, the uprights 126 and 128, the screen 130 and the transverse bar 132 all extend in a common vertical plane. The upper rail 122 is secured to a side wall of the uprights 126 and 128 so that it lies in a plane which is offset relative to the said vertical plane of the remaining structure of the section.

The upper rail 122 has a protruding end 136 to which is a fixed hinge connection that includes a vertically extending support member 138, in the form of a cylindrical rod, and a horizontally extending support member 140 displaying a circular opening 142. At the opposite end of the upper rail 122 is a movable hinge connection that consists of a tubular collar 144, a vertically extending rod 146 and a support 150 displaying a circular opening 148. Both rods 138 and 146 extend in a vertical plane that includes the upper rail 122 while the central axes of holes 142 and 150 extend in the vertical plane that includes the lower rail 124, the uprights 126, 128 the screen 130 and the transverse bar 132.

The assembly of sections 100, 102 and 104 is accomplished by inserting rods 138 and 146 of sections 100 and 104 in the upper extemity of posts 106, 108, 110 and 112. The middle section 102 is then mounted to sections 100 and 104 by inserting their rods 138 and 146 in their corresponding and associated opening 150 of section 100 and opening 142 of section 104. Once assembled, section 102 lies in a plane which is frontwardly offset to the plane including the main portion of sections 100 and 104. Section 102 may be made pivotable relative to sections 100 and 104 to define a door section in the fence by inserting one of the rods 138 or 146 in opening 150 of section 100 or opening 142 of section 104 to act as a pivot.

Although the invention has been described above in relation to three specific forms, it will be evident to the person skilled in the art that it may be refined and modified in various ways. It is therefore wished to have it understood that the present invention should not be limited in interpretation except by the terms of the following claims.

The embodiments of the invention in which an exclusive property or privilege is claimed are defined as follows:

1. A safety fence assembly for mounting to a floor of a building under construction comprising:

post means adapted to be vertically mounted to said floor, said post means having upper and lower ends;

at least one guard rail structure including at least an upper rail and upright means secured to said upper rail to define therewith a frame;

first hinge means mounted to said upper rail at one end thereof, said first hinge means including:

(i) a vertically extending pivot member adapted to be pivotally mounted to the upper end of said post means, or to hinge means of an adjacently disposed guard rail structure, and (ii) a horizontally extending support member having an opening therethrough to receive a pivot member of an adjacently disposed guard rail structure; and movable second hinge means slidably mounted to said upper rail at an opposite end thereof, said movable second hinge means including:

(i) a sliding member slidably mounted to said upper rail;

(ii) a pivot member vertically extending from said sliding member and adapted to be pivotally mounted to hinge means of an adjacently disposed guard rail structure, or to the upper end of said post means; and (iii) a support member horizontally extending from said sliding member and having an opening therethrough for receiving a vertically extending pivot member of a hinge means of an adjacently disposed guard rail frame structure.

2. An assembly as defined in claim 1, wherein said first hinge means is movable on said upper rail and includes a sliding member slidable mounted to said upper rail.

3. An assembly as defined in claim 2, wherein each vertically extending pivot member of both said movable hinge means extends in a vertical plane that includes said upper rail.

4. An assembly as defined in claim 3, wherein each opening of said support member both said hinge means has a central axis which is parallel and offset relative to said vertical plane.

5. An assembly as defined in claim 3, wherein said upright means consist of at least two vertical elements extending in said vertical plane; said guard rail structure further including a lower rail having a longitudinal axis extending parallel and offset relative to said plane.

6. An assembly as defined in claim 2, wherein said upright means consist of a pair of vertical elements located inwardly of opposite free ends of said upper rail; both said movable hinge means being slidably mounted on said free ends of said upper rail.

7. An assembly as defined in claim 1, wherein said rails and upright means are tubular.

8. An assembly as defined in claim 7, wherein said vertically extending pivot members of said hinge means consist of cylindrical rods.

9. An assembly as defined in claim 2, wherein each of said sliding members of both said hinge means is a tubular collar slidably mounted on said upper rail.

10. A safety fence assembly for mounting to a floor of a building under construction comprising:

post means adapted to be vertically mounted to said floor, said post means having upper and lower ends;

at least one guard rail structure including an upper rail, a lower rail and upright means having opposite upper and lower ends thereof secured to said upper and lower rails to define therewith a frame;

fixed hinge means secured to said upper rail at one end thereof, said fixed hinge means including:

(i) a vertically extending pivot member adapted to be pivotally mounted to the upper end of said post means, or to hinge means of an adjacently disposed guard rail structure, and (ii) a horizontally extending support member having an opening therethrough to receive a vertically extending pivot member of an adjacently disposed guard rail structure; and movable hinge means slidably mounted on said upper rail remote from said one end thereof, said movable hinge means including:

(i) a first member slidably mounted on said upper rail;

(ii) a pivot member vertically extending from said first member and adapted to be pivotally mounted to hinge means of an adjacently disposed guard rail structure, or to the upper end of said post means; and (iii) a support member horizontally extending from said first member and having an opening therethrough for receiving a vertically extending member of a hinge means of an adjacently disposed guard rail frame structure.

11. An assembly as defined in claim 10, wherein each vertically extending pivot member of said fixed and movable hinge means of a guard rail structure extends in a vertical plane that includes said upper rail.

12. An assembly as defined in claim 11, wherein each opening of said support member of said fixed and movable hinge means of a guard rail structure has a central axis which is parallel and offset relative to said vertical plane.

13. An assembly as defined in claim 11, wherein said upright means consist of at least two vertical elements extending in said vertical plane; said lower rail defining a longitudinal axis extending parallel and offset relative to said plane.

14. An assembly as defined in claim 11, wherein said upright means consist of two vertical elements extending in a second vertical plane that includes said lower rail; further comprising a wire mesh screen contained within and fixed to said vertical elements and said lower rail.

15. An assembly as defined in claim 14, further comprising a horizontally extending stabilizing rail intermediately located between said upper and lower rails.

16. An assembly as defined in claim 10, wherein said upright means consist of a pair of vertical elements including a first element located at one end of said frame and a second element located inwardly of free ends of the upper and lower rails remote from said one end of said frame; said movable hinge means being slidably mounted between said second element and said free ends of said upper and rail.

17. An assembly as defined in claim 10, wherein said vertically extending pivot members of said fixed and movable hinge means consist of cylindrical rods.

18. A safety fence assembly as defined in claim 1, further comprising anchor means for securing said post means to said floor; said anchor means comprising:

a base plate adapted to be fixedly mounted to said floor;

a vertically extending guide member having one end portion fixedly secured centrally of said base plate and an opposite end portion having a shape and a dimension to slidably and axially receive a correspondingly-shaped post.

19. A safety fence assembly as defined in claim 18, wherein said anchor means further comprise a cable fastener fixedly secured to said base plate for connecting thereto a safety cable used by workers during construction.

20. A safety fence assembly as defined in claim 18, wherein said guide member is mounted at right angle to said base plate; said guide member being welded at one extremity thereof to said base plate.

21. A fence assembly as defined in claim 18, wherein said guide member is mounted tangentially to said base plate; one end of said guide member having a side wall welded to said base plate.

22. A fence assembly as defined in claim 18, wherein said post means consist of tubular elements each having a lower end telescopically engaged with said tubular guide member of said anchor means.

23. A safety fence assembly as defined in claim 22, further comprising footboard retaining means telescopically engaged over each said tubular element at said lower end thereof.

24. A fence assembly as defined in claim 23, wherein said footboard retaining means include a collar portion and an inverted L-shaped board retainer having an upper end thereof fixedly secured to said collar portion and a lower end distantly spaced from the lower end of said tubular member to receive therebetween a footboard.

* * * * *